US008567568B2

(12) United States Patent
Korvenranta

(10) Patent No.: US 8,567,568 B2
(45) Date of Patent: Oct. 29, 2013

(54) ARRANGEMENT FOR COMPENSATING THE ROPE FORCES OF A TRACTION SHEAVE ELEVATOR

(75) Inventor: Sakari Korvenranta, Hyvinkää (FI)

(73) Assignee: Kone Corporation, Helsinki (FI)

( * ) Notice: Subject to any disclaimer, the term of this patent is extended or adjusted under 35 U.S.C. 154(b) by 872 days.

(21) Appl. No.: 12/591,205

(22) Filed: Nov. 12, 2009

(65) Prior Publication Data

US 2010/0089706 A1 Apr. 15, 2010

Related U.S. Application Data

(63) Continuation of application No. PCT/FI2008/000054, filed on May 5, 2008.

(30) Foreign Application Priority Data

May 25, 2007 (FI) ..... 20070412

(51) Int. Cl.
*B66B 7/10* (2006.01)

(52) U.S. Cl.
USPC ..... 187/264

(58) Field of Classification Search
USPC ..... 187/254, 264, 266, 412
IPC ..... B66B 7/10
See application file for complete search history.

(56) References Cited

U.S. PATENT DOCUMENTS

2005/0284705 A1 12/2005 Aulanko et al.
2006/0243541 A1 11/2006 Mustalahti et al.
2007/0012524 A1 * 1/2007 Valjus et al. ..... 187/412

FOREIGN PATENT DOCUMENTS

WO WO 2005090217 A2 * 9/2005

* cited by examiner

*Primary Examiner* — William A Rivera
*Assistant Examiner* — Stefan Kruer
(74) *Attorney, Agent, or Firm* — Harness, Dickey & Pierce, P.L.C.

(57) ABSTRACT

The object of the invention is an arrangement for compensating the rope forces of a traction sheave elevator, which elevator comprises at least a hoisting machine (5) and the traction sheave (6) connected to it, as well as an elevator car (1) suspended on hoisting roping (3), which is fitted to travel along guide rails (4), and in the rope suspension of which elevator is a rope force compensating element (8). The compensating element (8) comprises at least two compensation pulleys, of which the first part (3*a*) of the hoisting ropes (3) coming to the compensating element (8) are led over the top of the first compensation pulley (18) and the second part (3*b*) of the hoisting ropes (3) coming to the compensating element (8) are led to the second compensation pulley (19).

9 Claims, 2 Drawing Sheets

ARRANGEMENT FOR COMPENSATING THE ROPE FORCES OF A TRACTION SHEAVE ELEVATOR

CROSS-REFERENCE TO RELATED APPLICATION(S)

This application is a continuation of PCT/FI2008/000054 filed on May 5, 2008, which is an international application claiming priority from FI 20070412 filed on May 25, 2007, the entire contents of which are hereby incorporated by reference.

FIELD

The object of the present invention is an arrangement for compensating the rope forces of a traction sheave elevator.

BACKGROUND

The structures and quality of materials used in elevator technology as well as the control systems and operating systems have improved so much that nowadays it is increasingly more generally possible to implement the kinds of traction sheave elevators in which a counterweight is not used at all. In traction sheave elevators without counterweight, in which there are large travel heights, a number of hoisting ropes must be used to support the elevator car. In these kinds of elevators the hoisting ropes are essentially thick and long and it is essential in respect of elevator operation and safety that the portion of the hoisting ropes of the hoisting roping below the elevator car is kept sufficiently taut. In elevators without counterweight there must also be a rope force compensation appliance, which compensates rope elongations. In these elevator solutions is extremely important that the compensation of rope forces operates properly and reliably. In prior art, a compensating system connected to the hoisting roping is used to compensate the rope forces. One prior-art solution is a compensating system, which comprises a compensation pulley, around which the hoisting ropes are arranged to pass. The compensation pulley must contain an individual rope groove for each hoisting rope, as a result of which the compensation pulley must be made very wide in those types of elevators in which there are a number of essentially thick hoisting ropes. This causes problems in, among others, the aforementioned elevators of large hoisting heights because the wide compensation pulley takes a lot of valuable shaft space in a high shaft and additionally is difficult to situate in a suitable place in connection with the other structures of the elevator.

SUMMARY

The purpose of this invention is to eliminate the aforementioned drawbacks and to achieve a compact, simple, low-cost and effective arrangement for compensating the rope forces of a traction sheave elevator without counterweight, which arrangement is easy to install and which enables compensation of also large elongations.

Some inventive embodiments are also presented in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments.

One advantage of the arrangement according to the invention is that it does not take much space from the elevator shaft and is thus easy to dispose in a suitable place in connection with the other structures of the elevator depending on the rope transmission. Likewise the efficiency of other space use of the shaft improves. An advantage of the arrangement is also a simple, low-cost and straightforward construction. A further advantage is that the suspension points can easily be placed in the desired location and the suspension can easily be effected e.g. centrally as viewed from above the elevator car.

In the arrangement according to the invention the elevator can be an elevator with machine room or without machine room and the drive machinery of the elevator can be disposed in the elevator shaft or in a separate machine room or otherwise suitably in connection with the elevator. The compensating system of rope forces used in the arrangement according to the invention can be disposed in the elevator shaft or in a possible machine room or otherwise suitably in connection with the elevator. The compensating system of rope forces can be disposed in the top part or in the bottom part of the elevator or along the travel distance of the elevator. Preferably the compensating system of rope forces is close to the place in which the end of the hoisting roping is fixed.

BRIEF DESCRIPTION OF THE DRAWINGS

In the following, the invention will be described in detail by the aid of one example of its embodiment with reference to the attached drawings, wherein.

DETAILED DESCRIPTION

Figure 1:
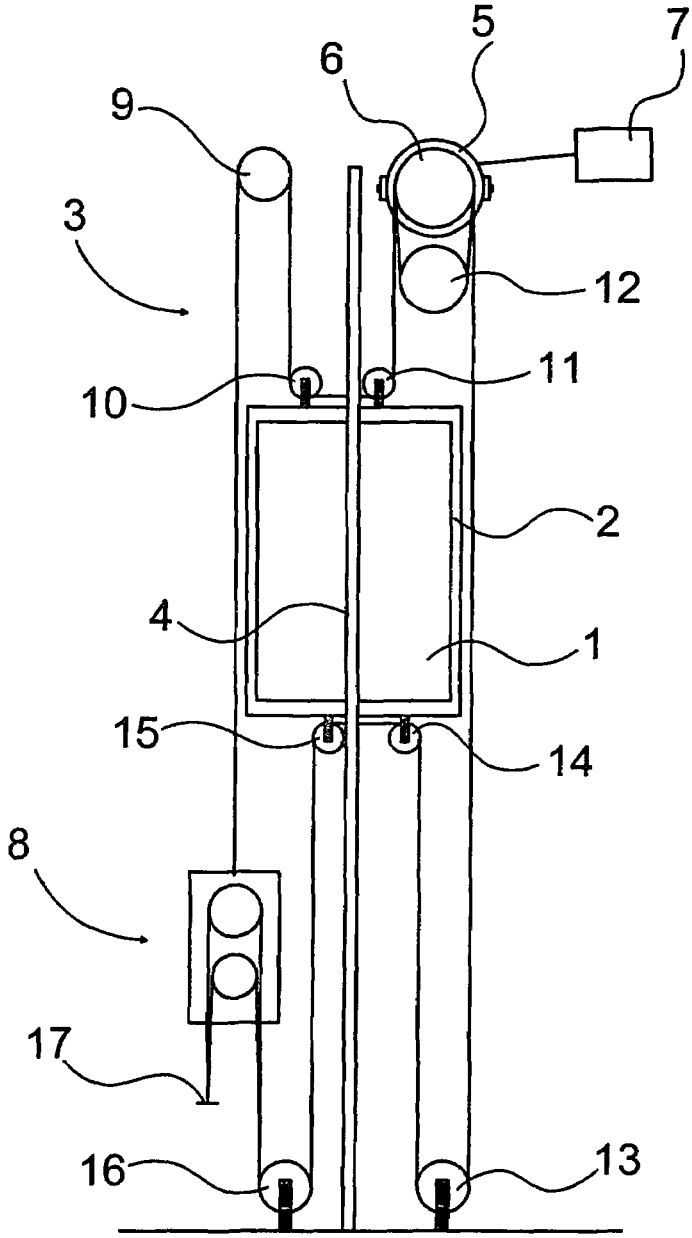
FIG. 1 presents a simplified and diagrammatic side view of an elevator solution, in which the arrangement according to the invention is used

FIG. 1 presents a simplified and diagrammatic side view of one elevator solution, in which the invention can be applied. The elevator of the figure is a traction sheave elevator without counterweight and without machine room, in which the hoisting machine 5 together with its traction sheave 6 controlled by the control unit 7 are disposed in the top part of the elevator shaft. The elevator car 1 is disposed inside the car sling 2 and it is suspended on the hoisting roping 3 and fitted to move backwards and forwards in the elevator shaft in essentially the vertical direction along guide rails 4. The elevator receives its lifting force from the hoisting machine 5 as a result of the friction between the traction sheave 6 and the hoisting ropes 3.

The hoisting roping 3 is fixed at its first end to the top part of the rope force compensation element 8 fitted to move in essentially the vertical direction in the elevator shaft, from where it is led to pass around the top of the diverting pulley 9 situated in the top part of the elevator shaft, and then from there under the diverting pulleys 10 and 11 fixed to the top part of the car sling 2, after which the hoisting roping 3 is led to pass around the top of the traction sheave 6, from where it passes under the diverting pulley 12 located in connection with the hoisting machine 5, after which again over the traction sheave 6. As a result of the arrangement the friction between the hoisting roping 3 and the traction sheave 6 can be made greater compared to if the hoisting roping 3 passed around the traction sheave 6 only once. From the traction sheave 6 the ropes are led onwards to the bottom part of the elevator shaft to pass around the bottom of the diverting pulley 13, after which over the diverting pulleys 14 and 15 fixed to the bottom part of the car sling 2 and then under the diverting pulley 16 located in the bottom part of the elevator shaft. After this the hoisting ropes are led onwards to the rope force compensation element 8, in which the hoisting ropes are arranged to pass around the top of the two diverting pulleys incorporated in the compensating element 8, after which the ropes are led to the fixing point 17 situated in some suitable place in the elevator shaft, to which the hoisting roping 3 is fixed at its second end. The rope force compensation element 8 and the parts of which it is comprised are presented in more detail in FIG. 2.

Figure 2:
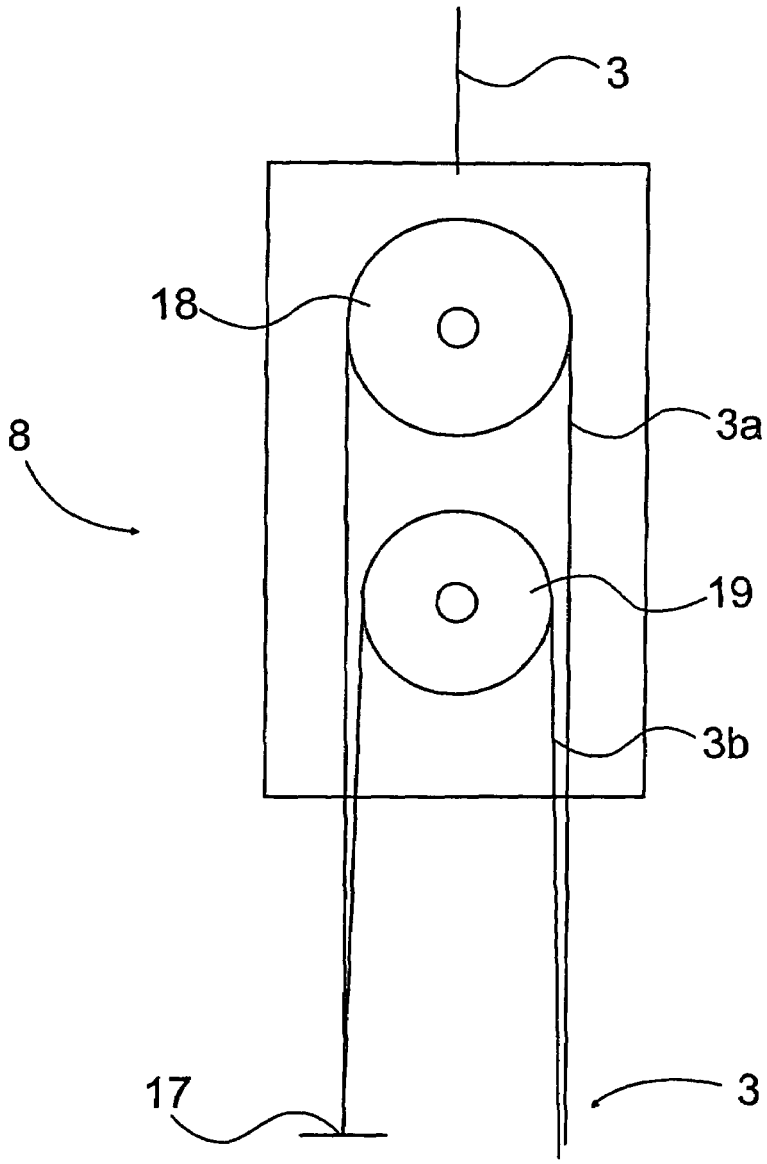
FIG. 2 presents a simplified and diagrammatic side view of an element for compensating rope forces according to the invention.

FIG. 2 presents a simplified and diagrammatic side view of the arrangement according to the invention. Compensation of the hoisting roping 3 is implemented by means of a rope force compensation element 8 fitted to move in essentially the vertical direction in the elevator shaft, which element comprises at least a first, i.e. higher, compensation pulley 18 and a second, i.e. lower, compensation pulley 19. In this case the upper compensation pulley 18 is behind the second compensation pulley 19 with respect to the incoming direction of the ropes coming to the compensating element 8.

Some of the hoisting ropes of the hoisting roping 3 coming to the compensating element 8, preferably e.g. half of the ropes, are arranged to pass around the top of the upper compensation pulley 18 and the rest of the ropes over the top of the lower compensation pulley 19. The hoisting ropes are distributed e.g. such that the first part 3*a* of the hoisting ropes of the hoisting roping 3 coming to the compensating element 8 are fitted to pass around the upper compensation pulley 18 and the second part 3*b* of the hoisting ropes of the hoisting roping 3 coming to the compensating element 8 are fitted to pass around the lower compensation pulley 19. In this case e.g. in the sequence according to one preferred embodiment every alternate hoisting rope 3*a* passes around the upper compensation pulley 18 and every alternate hoisting rope 3*b* passes around the lower compensation pulley 19.

After passing around the compensation pulleys 18 and 19 the hoisting ropes are led to the fixing point 17, to which the ropes are fixed at their second ends. The diameter of the upper compensation pulley 18 is suitably larger than the diameter of the lower compensation pulley 19, so that the ropes 3*a* going to the upper pulley do not hit either the ropes 3*b* going to the lower pulley or the lower compensation pulley 19. One suitable diameter difference is e.g. approx. two times the thickness of the hoisting rope. In addition the compensation pulleys 18 and 19 are situated essentially on the same vertical line, in which case the hoisting ropes 3*a* going to the upper compensation pulley 18 pass by the lower compensation pulley 19 essentially symmetrically on both sides of the compensation pulley 19.

As a result of this arrangement the rope pulleys 18 and 19 can be made narrower compared to prior-art compensation pulley solutions, in which all the hoisting ropes wrap in parallel over only one compensation pulley. Owing to the narrower compensation pulleys 18 and 19, the whole rope force compensation element 8 is narrower than prior-art solutions.

It is obvious to the person skilled in the art that the invention is not limited solely to the examples described above, but that it may be varied within the scope of the claims presented below. Thus for example the structure of the compensation element can vary. In this case the compensation pulleys do not necessarily need to be e.g. symmetrically one on top of the other, but instead they can be e.g. one after the other with respect to the incoming direction of the ropes, either essentially on the same horizontal plane or on a slightly different level, in which case the rearmost compensation pulley is higher than the frontmost one. In this case the compensation pulleys can be of the same size. The compensating system may also be upside-down with respect to what is explained in the example. In this case the ropes coming from above are fixed to the compensating system and the ropes coming from below are divided to pass around the compensation pulleys.

It is also obvious to the person skilled in the art that there can be more than two compensation pulleys, e.g. three, such that one compensation pulley is lower and two compensation pulleys of smaller diameters, which are situated so that the hoisting ropes rising to them pass by the lower compensation pulley are higher.

It is further obvious to the person skilled in the art that the hoisting ropes can be divided onto the compensation pulleys in a different manner to what is described above. Since it is necessary to wrap the rope bundles in the suspension for layout reasons, greater stress levels occur in the outermost ropes than in the innermost ropes. This can be compensated by placing e.g. in an 8-rope arrangement the four center ropes on the lower compensation pulley and the outermost ropes on the upper compensation pulley. In this case the larger rope length of the outermost hoisting ropes compensates the stress peaks caused by wrapping during the different phases of a run. A second factor affecting the distribution of the ropes is the direction of the rotation plane of the closest diverting pulley in the bottom part of the shaft. If for layout reasons the direction is such that a parallel rope bundle comes to the compensating system at an inclined angle with respect to the rotation plane, it is sensible to distribute the ropes on a case-by-case basis between the upper and the lower compensation pulley such that the ropes disturb each other as little as possible.

It is also obvious to the person skilled in the art that the invention can be used also just as well with other rope suspensions and in other types of suspensions than what is presented in the example. For example, the number and placement of the diverting pulleys can vary and also the location place of the compensating system can vary. The suspension ratio of the roping of the elevator can be selected to be otherwise. As the suspension ratio increases, correspondingly smaller torque is required of the machine. For example a very effective solution is achieved with a 4:1 suspension ratio.

The invention claimed is:

1. An elevator arrangement comprising:

a hoisting machine;

a traction sheave connected to the hoisting machine;

an elevator car configured to travel along guide rails and suspended on hoisting roping including a plurality of hoisting ropes;

a rope force compensating element to compensate for rope forces of the elevator arrangement, the rope force compensating element including at least a first and a second compensation pulley;

wherein a first portion of the plurality of hoisting ropes that engage the rope force compensating element pass around the first compensation pulley, and a second portion of the plurality of hoisting ropes that engage the rope force compensating element pass around the second compensation pulley;

wherein the first portion of the plurality of hoisting ropes passing around the first compensation pulley are longer than the second portion of the plurality of hoisting ropes passing around the second compensation pulley; and wherein the rope force compensating element is configured to move vertically within an elevator shaft.

2. An elevator arrangement comprising:

a hoisting machine;

a traction sheave connected to the hoisting machine, the hoisting machine and the traction sheave being configured to move an elevator car along guide rails via hoisting roping arrangement including a plurality of hoisting ropes; and a rope force compensating element to compensate for rope forces of the elevator arrangement, the rope force compensating element including at least a first and a second compensation pulley; wherein the plurality of hoisting ropes are led to the rope force compensating element in a first direction, a first portion of the plurality of hoisting ropes led to the rope force compensating element in the first direction extend around the first compensation pulley in the first direction, a second portion of the hoisting ropes led to the rope force compensating element in the first direction extend around the second compensation pulley in the first direction, the rope force compensating element is configured to move vertically within an elevator shaft.

3. The elevator arrangement according to claim 2, wherein the first compensation pulley is situated above the second compensation pulley on substantially the same vertical line.

4. The elevator arrangement according to claim 3, wherein a diameter of the first compensation pulley is greater than a diameter of the second compensation pulley.

5. The elevator arrangement of claim 2, wherein the first portion of the plurality of hoisting ropes includes alternate hoisting ropes among the plurality of hoisting ropes.

6. The elevator arrangement according to claim 2, wherein the first compensation pulley is situated at a first position and the second compensation pulley is situated at a second position, the first position being further from a position at which the plurality of hoisting are led to the rope force compensating element with respect to the first direction in which the plurality of hoisting ropes are led to the rope force compensating element.

7. The elevator arrangement according to claim 2, wherein the first compensation pulley is situated in a same plane as the second compensation pulley with respect to the first direction in which the plurality of hoisting ropes are led to the rope force compensating element.

8. The elevator arrangement according to claim 2, wherein the first portion of the plurality of hoisting ropes are longer than the second portion of the plurality of hoisting ropes.

9. An elevator arrangement comprising:

a hoisting machine;

a traction sheave connected to the hoisting machine, the hoisting machine and the traction sheave being configured to move an elevator car along guide rails via hoisting roping arrangement including a plurality of hoisting ropes; and a rope force compensating element to compensate for rope forces of the elevator arrangement, the rope force compensating element including at least a first and a second compensation pulley; wherein the plurality of hoisting ropes are led to the rope force compensating element in a first direction, a first portion of the plurality of hoisting ropes led to the rope force compensating element in the first direction pass around the first compensation pulley, a second portion of the hoisting ropes led to the rope force compensating element in the first direction pass around the second compensation pulley, the rope force compensating element is configured to move vertically within an elevator shaft, and the first portion of the plurality of hoisting ropes are fixed to a fixing point after passing around the first compensation pulley, and the second portion of the plurality of hoisting ropes are fixed to the same fixing point after passing around the second compensation pulley.

* * * * *